United States Patent [19]

Ryan et al.

[11] 4,430,058

[45] Feb. 7, 1984

[54] CERAMIC WORKPIECE HOLDER

[76] Inventors: John J. Ryan; Peter P. Laskey, both of 7809 Walker St., Philadelphia, Pa. 19136

[21] Appl. No.: 367,490

[22] Filed: Apr. 12, 1982

[51] Int. Cl.[3] ..... F27B 5/00

[52] U.S. Cl. ..... 432/259

[58] Field of Search ..... 432/258, 259; 211/41, 211/71, 125

[56] References Cited

U.S. PATENT DOCUMENTS

| | | | |
|---|---|---|---|
| 1,313,018 | 8/1919 | Rushton | 432/259 |
| 1,441,718 | 1/1923 | Albright | 432/259 |
| 2,743,499 | 5/1956 | Edgerton | 432/259 |
| 3,190,454 | 6/1965 | Brooks | 211/71 |

FOREIGN PATENT DOCUMENTS

| | | | |
|---|---|---|---|
| 659431 | 10/1951 | United Kingdom | 432/259 |

*Primary Examiner*—John J. Camby

*Attorney, Agent, or Firm*—John J. Simkanich

[57] ABSTRACT

A ceramic workpiece holder for use in kiln treatment of ceramics includes a base member of generally elongated configuration. This base can have two, three or four or more legs and can be formed with an upstanding support post intermediate its ends. Each leg of the base member carries a pair of blade members which can extend in any direction and can especially be placed parallel to its longitudinal axis. The blades can be positioned at an angle or can extend vertically upwardly with the upward edges extending parallel to the horizontal or at an angle thereto. Located in the support post are a plurality of pin members also extending generally parallel to the longitudinal axis of the base member and are spaced apart to define support points. A pair of grooves extend along each leg, one each for holding each blade. These grooves extend further than the length of each blade and are of a length and width to accommodate a blade during expansions and contractions. In use, a ceramic plate to be fired in a kiln may be supported with the edge thereof engaged by the upper edges of the blade members and with a back surface portion engaged by the ends of some of the pin members.

8 Claims, 3 Drawing Figures

CERAMIC WORKPIECE HOLDER

BACKGROUND OF THE INVENTION

This invention relates to workpiece holders and, more particularly, to holders for supporting ceramic plates in a kiln during the firing process.

In the manufacture of china or ceramic substrate plates and/or plaques, there is a firing cycle in which the raw ceramic, "green ware", or partially finished piece is placed into a kiln and heat treated. As this manufacture is practiced by the ceramic hobbyist, the ceramic is supported on shelves supported in the kiln in a variety of ways. Various stilt arrangements are utilized, but most of these arrangements are time-consuming to utilize. This is because the supporting of the plates is a delicate operation requiring careful manipulation.

Accordingly, it is among the primary objects of this invention to provide a ceramic object support for use in heating kilns which is simple, inexpensive and easy to use and which provides a steady support or "rest" for a "proposed" object.

Various ware supports have been disclosed in the art.

Irwin, U.S. Pat. No. 1,941,941, shows a plate shaped ware support having triangularly shaped pins.

Irwin, U.S. Pat. No. 3,948,594, shows a plate shaped ware support having support spheres.

Schreiber, U.S. Pat. No. 2,208,734, shows a semicircular ware support having conically shaped pins.

Dopera, U.S. Pat. No. 2,881,502, shows an adjustable kiln setter having movable pins.

Fear, U.S. Pat. No. 1,877,424, shows a ware support having triangularly shaped pins.

Carlson, U.S. Pat. No. 1,530,479, shows a ware support having a plurality of vertically extending pins.

Jackson, U.S. Pat. No. 46,109, shows a plate type support having pyramidal pins.

Schreiber, U.S. Pat. No. 2,273,475, shows a semicircular ware support having vertically extending pin supports.

Cummings, U.S. Pat. No. 3,137,910, shows a plate shaped ware support having a surface covered with small ridges.

SUMMARY OF THE INVENTION

The objects of this invention are accomplished by providing a workpiece member including a generally elongated base member having a plurality of laterally extending legs, at least two of which are integrally formed with an upright support post located between the legs so that the base member has a first and second oppositely extending portion or a plurality of extending portions from a central upright. Each portion of the base member carries a pair of blade members extending generally parallel to its longitudinal axis and spaced apart so that the upper edges thereof define supports. These upper edges are inclined at an angle with respect to the base member or can be parallel thereto. Extending outwardly from opposite sides of the support posts, also generally parallel to the longitudinal axis of the base member, are a plurality of support pin members defining support points against which a lateral surface of the plate or plaque may rest when an edge thereof is supported on the upper edges of the blade members.

A pair of grooves each extend parallel to the longitudinal axis of each base member portion for its entire length. One of the blade members is positioned in each groove. Each groove is wider than and considerably longer than the blade member which it holds. This allows for expansion and contraction during temperature changes.

DESCRIPTION OF THE DRAWINGS

For a better understanding of the invention, reference is made to the following description of a preferred embodiment thereof, taken in conjunction with the figures of the accompanying drawing, in which.

DETAILED DESCRIPTION OF THE INVENTION

Figure 1:
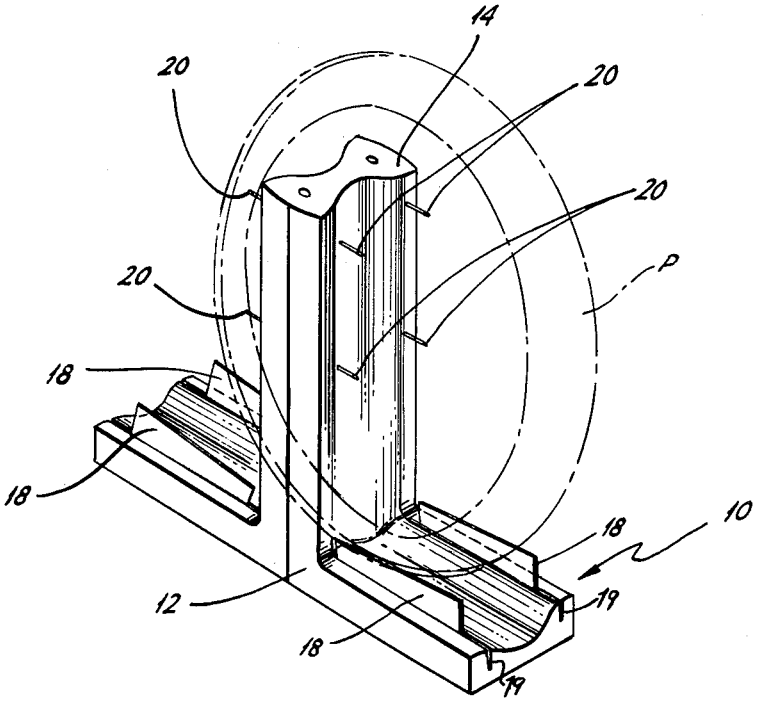
FIG. 1 is a perspective view of a ceramic plate holder in accordance with this invention.

Referring now to the drawings, there is illustrated, FIG. 1, a ceramic workpiece holder 10 comprised of a generally rectangular elongated base member 12 and an upright support post member 14. The base member 12 and support post member 14 are integrally formed of a ceramic material and the bottom of the base member 12 can be formed with protuberances 16 functioning as feet members. The base member 12 is divided into two support portions, each extending from opposite sides of the support post 14. Thus, the base member and support post are related to support two plates or plaques during the firing cycle.

Each portion of the base member 12 carries a pair of parallel blade members 18 or blade extending parallel to the longitudinal axis of the member. Each blade member 18 is long and narrow like a knife blade of narrow sheet of metal and formed of conventional metal alloys able to withstand a relatively high temperature used in ceramic kilns. The blade members 18 are held in parallel extending elongate grooves 19, one groove 19 for holding each blade 18. Each groove 19 is long and narrow and approximately one and one-half to twice the width of the blade 18 and extends a substantial distance beyond the length of the blade 18. Preferably, as shown in the FIG. 1, these grooves 19 extend the entire length of the base member 12.

This oversizing of the groove 19 dimensions does not inhibit the groove 19 from supporting a blade 18. It does however allow for the expansions and contractions of the dissimilar materials which make up each element during repeated kiln and other processing operations. Otherwise, such expansions and contractions would contribute to a failure (cracking) of the ceramic base member 12.

Figure 2:
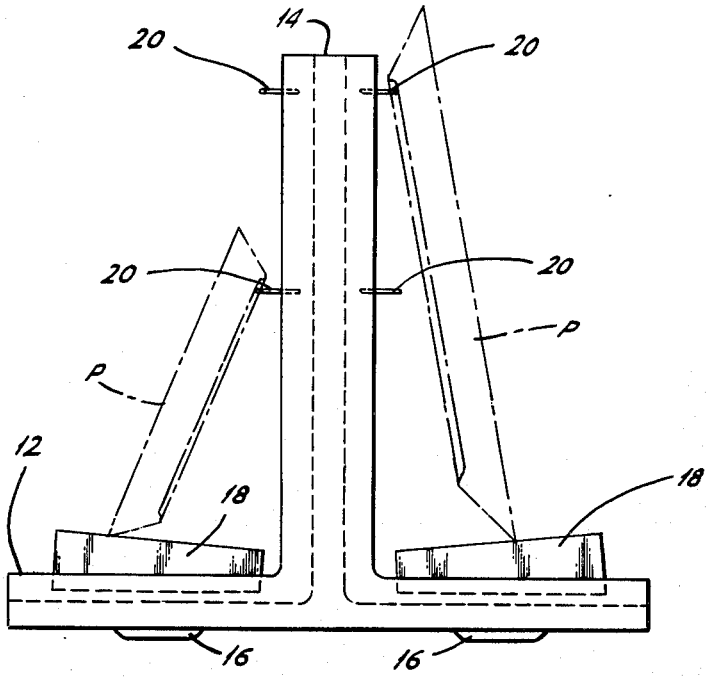
FIG. 2 is a front plan view of a ceramic plate holder illustrated in FIG. 1.
Figure 3:
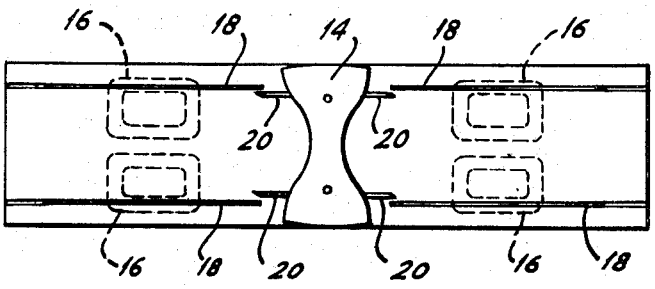
FIG. 3 is a top plan view of the plate holder illustrated in FIG. 2.

As seen in FIGS. 2, 3, the ends of the blade members 18 are spaced from the support post 14 and from the free ends of the base member 12. As also best seen in FIG. 2, the upper edges of the blade members 18 are inclined at an angle to the horizontal plane defined by the base member 12. As will be made clearer hereinafter, the angular orientation of the upper edge of the blade supports with the horizontal plane is used to retain the plates or plaques in a tilted position and to minimize the possibility of the plates tipping toward the free end of the base member 12 and becoming dislodged from the support 10. In the embodiment illustrated, the angle between the upper edge of the blade 18 and the horizontal plane defined by the base member 12 is in the order of about five (5°) degrees. Other angles may be utilized, if desired, or the blade 18 top edge can be parallel with the horizontal.

Extending outwardly from the support post 14 in a direction parallel to the longitudinal axis of the base member 12 are a plurality of pin members 20. These pin members 20, of relatively small dimension, are spaced apart on each side of the support post 14 in horizontal and vertical alignment to form support points. Each horizontally aligned pair of pin members 20 provide a pair of support points for a lateral surface of the plate or plaque to be fired. The vertical spacing is such to accommodate different sized plates of plaques as shown in FIG. 2. These pins are also made of conventional metal alloys capable of withstanding high temperatures.

Manufacture of the support 10 is relatively simple. Conventional ceramic material can be placed in a conventional mold shaped to provide the T-shaped configuration of the support 10. Thereafter, while the material is in the "green" state, the grooves 19 are formed, the support blades 18 are inserted in the grooves 18 and the pins 20 can be embedded in the relatively soft ceramic material. Thereafter, the support itself is placed in a kiln and heat treated or fired in a conventional manner to harden the "green ware". The shrinkage of the material during this firing cycle is such that pins 20 are retained in a fixed position. The blades 18, however, can alternately be inserted in the grooves 19 after the firing treatment.

Use of the ceramic plate or plaque support 10 is relatively simple and facilitates the support of plate or plaques in a kiln. The plates or plaques P to be fired are placed edgewise on the upper edges of the blade members 18 at any position such that the plate leans toward the support post 14. The lateral surface of the plate or plaque P is supported against the ends of horizontally aligned pin members 20 so that the plate is spaced from the support post 14. This is early illustrated in FIG. 2 which also illustrates the support of different sized plates or plaques P, one on an upper pair of pin members 20 and the other on the lower pair of pin members 20. Thereafter, the holder 10 or plaques P are placed in a kiln and fired in a conventional manner. Contact of the plate or plaques P with support structure is minimized so as not to interfere with the heat treatment, it being understood that such contact is essentially point contact. Because of the angle of the upper edges of the blade members 18, the tendency for the plates or plaques P to tip off the holder is minimized.

While in the foregoing there has been described a preferred embodiment of the invention, it should be obvious to those skilled in the art that various changes and modifications can be made without departing from the true spirit and scope of the invention as recited in the appended claims. As an example, the blades 18 can be mounted in a block having grooves 19, this block being movable along a leg or base member 12 or vertical support post 14 to provide an adjustable workpiece holder.

What we claim is:

1. A ceramic workpiece holder comprising: an elongated base member; a support post upwardly standing from said base member and dividing said base member into separate support portions; a pair of elongate grooves extending along each said separate support portion; and a plurality of pairs of blades, each said pair in parallel spaced-apart relationship positioned in respective ones of said groove pairs.

2. The ceramic workpiece holder of claim 1 also including a plurality of spaced-apart support pins extending outwardly from said support post, on opposing sides thereof.

3. The ceramic workpiece holder of claim 2 wherein the upper edge of each said blade extends at an angle to the horizontal plan defined by said support base.

4. The ceramic workpiece holder of claim 2 wherein the upper edge of each said blade extends parallel to the horizontal.

5. The ceramic workpiece holder of claim 3 wherein the angle between the upper edge of each said blade and the horizontal plane is about five (5°) degrees.

6. The workpiece holder of claim 5 wherein said support post extends vertically upwardly and wherein said support pins extend horizontally and are horizontally aligned to form support points for a lateral surface of a said workpiece in each separate support portion.

7. The ceramic workpiece holder of claim 6 wherein said support pins are arranged in horizontal and vertical alignment.

8. The ceramic workpiece holder of claim 7 wherein said blades are each knife blades of narrow sheet metal.

* * * * *